United States Patent [19]

Linden

[11] 4,251,916

[45] Feb. 24, 1981

[54] MEANS IN SCISSORS FOR BALANCING THE CLOSING FORCE OF THE SCISSORS

[76] Inventor: Olavi Linden, Björkkulla, 10330 Billnäs, Finland

[21] Appl. No.: 92,292

[22] Filed: Nov. 7, 1979

[30] Foreign Application Priority Data

Sep. 28, 1979 [FI] Finland ..... 793023

[51] Int. Cl.[3] ..... B26B 13/16

[52] U.S. Cl. ..... 30/268

[58] Field of Search ..... 30/268, 269, 254

[56] References Cited

U.S. PATENT DOCUMENTS

| | | | |
|---|---|---|---|
| 627,738 | 6/1899 | Nickerson | 30/268 |
| 741,576 | 10/1903 | Davies | 30/268 |
| 2,645,850 | 7/1953 | Sejman | 30/268 X |
| 2,741,844 | 4/1956 | Sejman | 30/268 |
| 3,611,570 | 10/1971 | Laurenti | 30/268 |
| 3,672,053 | 6/1972 | Wiss | 30/268 |

FOREIGN PATENT DOCUMENTS 2458218 6/1976 Fed. Rep. of Germany .

*Primary Examiner*—Jimmy C. Peters
*Attorney, Agent, or Firm*—Ladas & Parry

[57] ABSTRACT

The invention relates a means in scissors for balancing the closing force of the scissors. It comprises a wave-shaped spring washer clamped between the head of the scissors rivet and the shear blade, at least one of the contact surfaces being wave-shaped and provided with the same number of waves as the spring washer.

5 Claims, 4 Drawing Figures

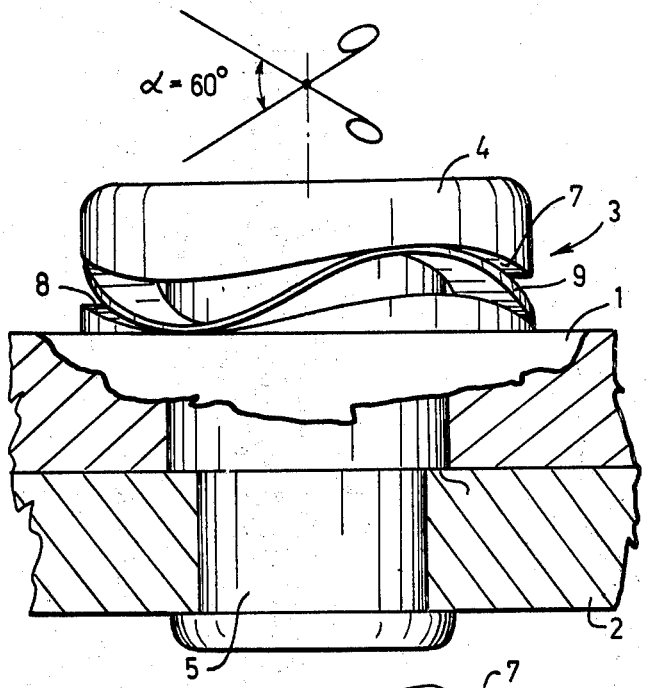
FIG. 1
FIG. 2
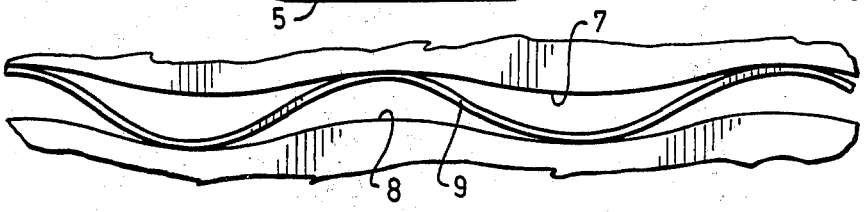
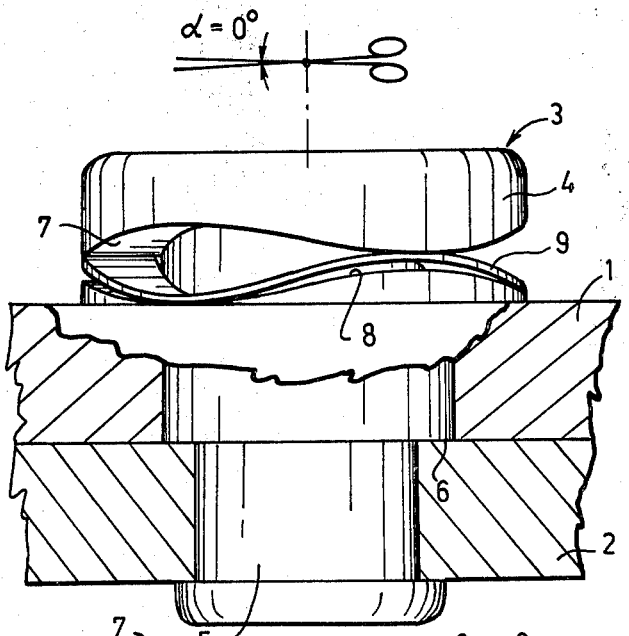
FIG. 3
FIG. 4
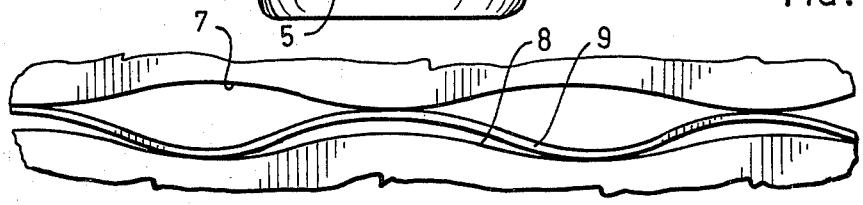

MEANS IN SCISSORS FOR BALANCING THE CLOSING FORCE OF THE SCISSORS

The present invention relates to a means in scissors for balancing the closing force of the scissors, comprising a spring washer which is wave-shaped along the periphery and surrounds the scissors rivet or screw and is clamped between the surface of the rivet head facing the shear blades and a surface on one of the shear blades.

In a good pair of scissors the closing force must vary with the opening angle of the scissors such that the closing force is zero (the scissors feel loose) when the opening angle is about 45° to 60°, whereafter the closing force, as the opening angle diminishes, quickly increases to a desired maximum value and thereafter remains constant until the scissors are completely closed, i.e. when the opening angle is zero. This desired change in the closing force, which is hereafter called the movement of the scissors, has no rational reason but is based on a common notice about how a good pair of scissors ought to "feel". Variations in the closing force considerably impair the movement of the scissors.

The movement of the scissors is affected by the tightening of the scissors rivet or screw and the geometry of the shear blades. Hardening strains occurring in the manufacture of scissors always result in undesired variations in the geometry of the blades which, in turn, cause variations in the closing force which is felt as an uneven movement of the scissors. These variations must often be corrected by means of after-trimming the shape of the blades which is time-consuming and, accordingly, cost-involving.

In order to avoid an after-trimming of the scissors, it has been previously proposed to place a spring washer between the rivet head and the outer surface of one of the shear blades. A spring washer absorbs variations in the geometry of the shear blades which considerably reduces the need for trimming. Such scissors, however, suffer from a substantial disadvantage due to which they have not won any noteworthy popularity. On account of the action of the spring washer, the closing force namely does not diminish to zero when the opening angles are large, the scissors do not feel loose when open and their movement is, accordingly, not satisfactory.

In a novelty examination carried out by the inventor, only one earlier publication dealing with this problem was found, namely the German Offenlegungschrift No. 2,458,218. In the construction according to this publication, the closing force is regulated as a function of the opening angle of the scissors by means of a coarsely threaded pin which is located in the fulcrum of the scissors and which, depending on the opening angle of the scissors, adjusts the relative distance between the shear blades. However, this construction is complicated and difficult to manufacture, and the threads will obviously wear out rather quickly.

The present invention relates to a means which in a simple way in itself combines the advantages of the spring washer with a satisfactory movement in the scissors. This is according to the invention achieved in that at least one of contact surfaces has a wave shape with the same number of waves as the spring washer. Because also at least one of the contact surfaces is wave-shaped, the waves in the spring washer and in the contact surface can be given such a relative position that, when the scissors have a large opening angle, the waves in the spring washer and in the contact surface are in "the same phase", i.e. the waves in the spring washer are high, the tension in the washer is low, while the waves at a small opening angle are in "the opposite phase", i.e. the spring washer is more flattened and has a high tension. This circumstance results in a good movement of the scissors with a loose feel when the opening angle is large and, regardless of any irregularities in the geometry of the blades, an even closing force when the opening angles are smaller. The means according to the invention, in addition, of course, has all the above mentioned advantages that ensue from the use of a spring washer.

According to one preferred embodiment, the spring washer and the contact surface or surfaces comprise 2 or 4, preferably 3 waves. When the number of waves is three, the scissors feel loose when the opening angle is 60°, while two and four waves correspond to a "loose" opening angle of 90° and 45°, respectively.

The means according to the invention utilizes the cooperation between the spring washer and a wave-shaped surface. Therefore, the other contact surface can be planar. In this case, however, the spring washer must be affixed in one way or another to the planar contact surface so as to follow it during the shearing movements of the scissors.

It is also possible to make both contact surfaces wave-shaped. It has been found that the spring washer in this case by itself follows one of the contact surfaces wherefore the spring washer need not in this case be locked to either contact surface.

The means according to the invention will be described in more detail in the following with reference to the accompanying drawing in which FIG. 1 is a side view of the rotary axis portion in a pair of opened scissors, FIG. 2 shows schematically 270° of the spring washer and the contact surfaces when spread in a plane and in the position according to FIG. 1, FIG. 3 is a side view of the rotary axis portion of a closed pairs of scissors, and FIG. 4 illustrates in a corresponding manner as FIG. 2 the spring washer and contact surfaces in the position according to FIG. 3.

The FIGS. 1 and 3 illustrate two parallel shear blades 1 and 2 interconnected by means of a rivet 3 passing through the blades. The rivet has a head 4 and a shaft 5 provided with a shoulder 6 by means of which the distance between the blade 1 and the rivet head 4 automatically becomes correct during riveting. A wave-shaped spring washer 9 is located between the surface 7 of the rivet head 4 facing the blade 1 and the outer surface 8 in the blade 1. The spring washer has the shape of a ring which is wave-shaped in the peripheral direction and surrounds the rivet shaft 5. In the embodiment shown in the Figures, the spring washer has three waves, i.e. three wave crests and three wave troughs. The waves are essentially of sinusoidal shape.

According to the invention, the contact surfaces 7,8 for the spring washer on the rivet head and the blade 1, respectively, are wave-shaped and provided with the same number of waves as the spring washer, i.e. three waves in the embodiment shown. The contact surface 8 is arranged on an annular elevation on the surface of the blade 1. The wave amplitude of the contact surfaces is considerably lower than the amplitude of the waves in the spring washer.

The FIGS. 1 and 2 illustrate a pair of scissors with the opening angle of 60°, as is schematically shown above the rivet head. In this position of the blades, the waves in the spring washer and in the contact surfaces are "in phase", i.e. the wave crests and troughs in the spring washer are located in recesses in the contact surfaces. The spring washer is now in a state approximately corresponding to its free state, wherefore it exerts hardly any compressive force on the shear blades. The scissors feel loose and the closing force is zero.

Hereafter, when one starts to perform a shearing movement with the scissors, whereby the opening angle diminishes, the contact surfaces 7,8 are displaced in relation to each other in the peripheral direction, whereby the spring washer following one of the contact surfaces is compressed to a flatter and flatter shape until it assumes the position shown in FIGS. 3 and 4. Because of the increasing compression of the spring washer, it presses the blades with more and more force against each other whereby the closing force component caused by the spring washer increases. In the FIGS. 3 and 4, the opening angle is zero and the waves in the contact surfaces are out of phase relative each other by half a wavelength. The spring washer has followed the contact surface 8.

The means described above is advantageous also in that respect that the closing force of the scissors is great right up to the completion of the shearing movement because the closing force of worn scissors often decreases just before the blade points meet each other which impairs the movement of the scissors.

One of the contact surfaces, e.g., the surface 8, can be made planar. In this case the spring washer must be fixed so as to follow this surface during the relative rotation of the contact surfaces. The rivet 3 can, of course, be replaced by a screw permitting the adjustment of the spring force.

What I claim is:

1. A means in scissors for balancing the closing force of the scissors, comprising a spring washer which is wave-shaped along the periphery and encloses the scissors rivet or screw and is clamped between the contact surface of said rivet head facing the shear blades and a contact surface on one of said shear blades, wherein at least one of the contact surfaces has a wave shape with the same number of waves as the spring washer.

2. A means as claimed in claim 1, wherein said spring washer and said contact surface or surfaces comprise 2 to 4, preferably three waves.

3. A means as claimed in claim 1 or 2, wherein only one of said contact surfaces is wave-shaped and said spring washer is affixed to the other contact surface.

4. A means as claimed in claim 1 or 2, wherein both contact surfaces are wave-shaped and said spring washer is unfixed.

5. A means as claimed in claim 1, wherein said contact surface or surfaces have a smaller wave amplitude than said spring washer.

* * * * *